US006494421B1

(12) United States Patent
Harrison

(10) Patent No.: US 6,494,421 B1
(45) Date of Patent: Dec. 17, 2002

(54) CYLINDRICAL ACTUATOR

(76) Inventor: John Harrison, White House, Caldwell, Richmond, North Yorkshire DL11 7PU (GB)

( * ) Notice: Subject to any disclaimer, the term of this patent is extended or adjusted under 35 U.S.C. 154(b) by 0 days.

(21) Appl. No.: 09/831,482

(22) PCT Filed: Nov. 5, 1999

(86) PCT No.: PCT/GB99/03687

§ 371 (c)(1),
(2), (4) Date: Nov. 14, 2001

(87) PCT Pub. No.: WO00/28619

PCT Pub. Date: May 18, 2000

(30) Foreign Application Priority Data

Nov. 9, 1998 (GB) ..... 9824550
Jun. 4, 1999 (GB) ..... 9913105

(51) Int. Cl.[7] ..... A47F 5/02
(52) U.S. Cl. ..... 248/131; 248/149; 343/764
(58) Field of Search ..... 248/131, 149, 248/161, 404, 694; 343/700, 764, 781

(56) References Cited

U.S. PATENT DOCUMENTS 2,096,050 A 10/1937 Lucker
4,427,948 A * 1/1984 Anderson ..... 343/764
4,799,064 A * 1/1989 Nakamura ..... 343/766
4,918,363 A * 4/1990 Hollis et al. ..... 343/765
5,355,145 A * 10/1994 Lucas ..... 343/882
5,945,961 A * 8/1999 Price et al. ..... 343/757

FOREIGN PATENT DOCUMENTS

GB 2 266 996 A 11/1993
JP 08298408 11/1996

* cited by examiner

*Primary Examiner*—Ramon O. Ramirez
(74) *Attorney, Agent, or Firm*—Fredrikson & Byron, P.A.

(57) ABSTRACT

Actuator, especially suited for an actuating mechanism for parabolic and other reflector dishes. The actuator comprises two co-axial cylinders (8, 12). A helical guideway (10) is provided on the outer surface of the inner cylinder (12) or the inner surface of the outer cylinder (8), and a plurality of guide means are provided on the other of the outer surface of the inner cylinder (12) or the inner surface of the outer cylinder (8) to run in or along the helical guideway (10). The actuator is elongated or contracted by relative rotational movement of the cylinders (8, 12).

24 Claims, 5 Drawing Sheets

CYLINDRICAL ACTUATOR

The invention relates to actuating mechanisms and in particular to such mechanisms for use with parabolic reflector dishes.

Parabolic reflector dishes are used to collect and focus energy carried by waves. Examples of the waves include radio waves for communications and solar radiation which is focused to produce heat for power generation or to drive a chemical reaction.

Dishes are usually mounted on a structure with horizontal and vertical rotation axes providing altitude and azimuth tracking. It is known that placing the horizontal axis away from the centre of the dish places the dish closer to the ground when the dish is horizontal. With this configuration the vertical rotation axis is usually a kind of relatively simple turntable. The horizontal axis typically is more complicated. The actuating mechanism for rotating the dish about the horizontal axis is usually a hydraulic ram or a screw jack similar to that disclosed in U.S. Pat. No. 2,096,050. Both these mechanisms tend to be expensive and so are relatively small to keep their size and cost down. The small size means the mechanism must be placed close to the horizontal axis, which cause small movements of the mechanism to produce large movements of the dish which makes accurate tracking difficult. Placing the mechanism close to the axis also produces large forces on the horizontal axis itself, the structure which supports it and the mechanism, requiring them to be of high strength and therefore cost.

One method used to overcome the small sizes of current actuating mechanisms is to provide a 'walking ram' system which provides both altitude and azimuth tracking. This is achieved with a series of alternate extensions and contractions of appropriately mounted hydraulic rams. This system is however complicated and therefore expensive to manufacture and difficult to control.

According to the present invention, an actuator comprises:

a first generally cylindrical member;

a second generally cylindrical member received at least partially within, and co-axial with, the first generally cylindrical member;

a generally helical guideway provided on one of the first and second generally cylindrical members; and, a plurality of guide means provided in a generally corresponding helical arrangement on the other of the first and second generally cylindrical members and being arranged to run along the helical guideway, in which relative rotation of the first and second generally cylindrical members about their common axis causes the guide means to run along the helical guideway to cause relative axial movement between the first and second generally cylindrical members.

With the actuator of the present invention, the elongation or contraction of the actuator is achieved by the relative rotation between the two parts. Accordingly, this allows very accurate control of the change in length of the actuator, since a large rotational movement results in a relatively small change in the length of the actuator. Furthermore, the actuator gives a high mechanical advantage, and therefore a relatively low force is able to overcome a much higher force resisting the change in length of the actuator. This allows the actuator to move heavy objects. Therefore, the present invention gives an actuator which is reliable, accurate and efficient. The actuator according to the present invention is also less expensive to manufacture than other known actuators.

The actuator of the present invention can be made more easily and more cheaply than prior art actuators. In particular, it is preferred that the guideway is formed as a separate member to the cylinder. The formation of a separate guideway which is attached to the cylindrical member, for example by welding, is much easier and cheaper than providing a cylinder having a thick initial wall, and forming a guideway into the wall.

In one example of the present invention, the helical guideway is provided on the inner surface of the first generally cylindrical member, and the plurality of guide means are provided on the outer surface of the second generally cylindrical member. In an alternative arrangement, the helical guideway is provided on the outer surface of the second generally cylindrical member and the plurality of guide means are provided on the inner surface of the first cylindrical member.

Preferably, the helical guideway is in the form of a channel. In this case, the guide means are arranged to run inside the channel.

Advantageously, the guide means include a first set of guide means which contact the base of the channel. This ensures the two generally cylindrical members remain generally co-axial. Advantageously, the guide means include a second set of guide means which engage the side walls of the channel. This prevents undesired axial movement between the two generally cylindrical members.

Preferably, the guide means are rotatable guide means such as wheels or rollers. These guide means are rotated as they run along the helical guideway. This results in low friction between the members acting against rotation, whilst ensuring close contact between the members to reduce any play, and thereby prevent jamming.

Where the helical guideway is a channel, it is preferred that a first set of rotatable guide means are arranged with an axis of rotation generally parallel to the base of the channel, and that the rotatable guide means have a width smaller than the width of the channel. The axis of rotation may also be generally perpendicular to the flanges or side walls of the channel. The first set of rotatable guide members are arranged to contact and run along the base of the helical guideway channel. Additionally, it is preferred that a second set of the rotatable guide means are arranged with an axis of rotation generally parallel to the flanges. This axis of rotation may also be generally perpendicular to the base of the channel. Such rotatable guide means are arranged to contact and run along the side walls of the channel. The second set of rotatable guide means have a diameter less than the spacing between the opposed side walls of the channel.

It is beneficial that the second set of guide means are slightly offset from the helical path of the helical guideway such that some of the second set of guide means contact and run along one side wall of the channel, and the others of the second set of guide means contact and run along the opposite side wall of the channel. With this arrangement, when there is a change between a compressive and a tension force on the actuator, some of the second set of rotatable guide means are in contact with the side wall of the channel in the direction of the force and thereby prevent undesired longitudinal movement between the two generally cylindrical parts of the actuator.

In an alternative arrangement of the present invention, the generally helical guideway is formed as a projection from the side wall of the respective generally cylindrical member. In this case, it is preferred that one set of guide means are rotatable about an axis generally parallel to the side wall of the generally cylindrical member, and in use runs along the side wall of the generally cylindrical member. In this case, a strip, typically of metal, may be provided on the side wall of the cylinder along which the guide means run. This protects the cylindrical member from wear. A second set of rotatable guide means may be provided which are rotatable about an axis generally parallel to the side faces of the projection, and which means are arranged to run along the side faces of the projection.

In this case, it is advantageous that some of the second set of guide means contact and run along one side face of the projection and others of the second set of guide means contact and run along the other side face of the projection. In this way, relative axial movement between the two generally cylindrical parts of the actuator is prevented when the force applied to the actuator changes from a compressive to a tension force and vice versa.

In all cases, some, or preferably all, of the components including the guide means and helical guideway, are preferably formed of durable and advantageously corrosion resistant material. This helps prevent deterioration of the components which is especially important as these cannot be protected efficiently in other ways due to their relative movement.

It is preferred that the radial position of the guide means are adjustable. This ensures centring of the first and second generally cylindrical members with respect to each other, and ensures that the guide means are in the optimum position to contact the helical guideway. This in turn ensures smooth running of the guide means on the guideway and thereby prevents jamming. The radial position of the guide means may be achieved by providing the guide means on a threaded shaft, in which case the distance between the side of the generally cylindrical member on which the guide means are mounted and the guide means themselves can be adjusted by rotation. In this case, the threaded shaft may be threaded directly into the side wall of the generally cylindrical member, and therefore the spacing of the guide means can be adjusted by rotation of the shaft. Alternatively, nuts may be provided on the threaded shaft, the nuts being provided on either side of the side wall of the generally cylindrical member to sandwich the side wall, and in this case adjustment of the nuts on the threaded shaft will adjust the effective length of the shaft and hence the spacing of the rotation guide member from the side wall of the generally cylindrical member.

In a preferred aspect of the present invention, further guide means may be provided on the generally cylindrical member on which the helical guideway is provided, these guide means being arranged to contact the side wall of the other generally cylindrical member. This further assists in maintaining the coaxial arrangement between the generally cylindrical members and thereby prevents jamming and ensures smooth operation. These guide means are also preferably rotatable.

Advantageously, further generally cylindrical members may be provided which are connected to the first or second cylindrical member by a similar arrangement of generally helical guide means and a plurality of guide members which are arranged in a generally corresponding helical fashion. With this arrangement, any desired number of coaxial components can be arranged in telescopic fashion to achieve any desired overall length of actuator.

The actuator according to the present invention may advantageously be used for movement of a dish, such as a parabolic reflector dish for the collection and/or focusing of energy. Due to the accurate control of the actuator, and the good mechanical advantage, the actuator of the present invention may be provided close to the axis about which the dish is required to turn. However, the reduced cost of the actuator of the present invention compared to prior actuator means that larger actuators can be formed for the same cost as smaller prior actuators, and therefore the actuator can be provided further from the axis about which the dish is to rotate. This enables a reduction in the force required to turn the dish, and as the actuation is further from the axis, allowing greater accuracy and control and reducing the strength and therefore cost of axis and the structure supporting it.

A number of embodiments will now be described by way of example with reference to the following drawings wherein.

Figure 1:
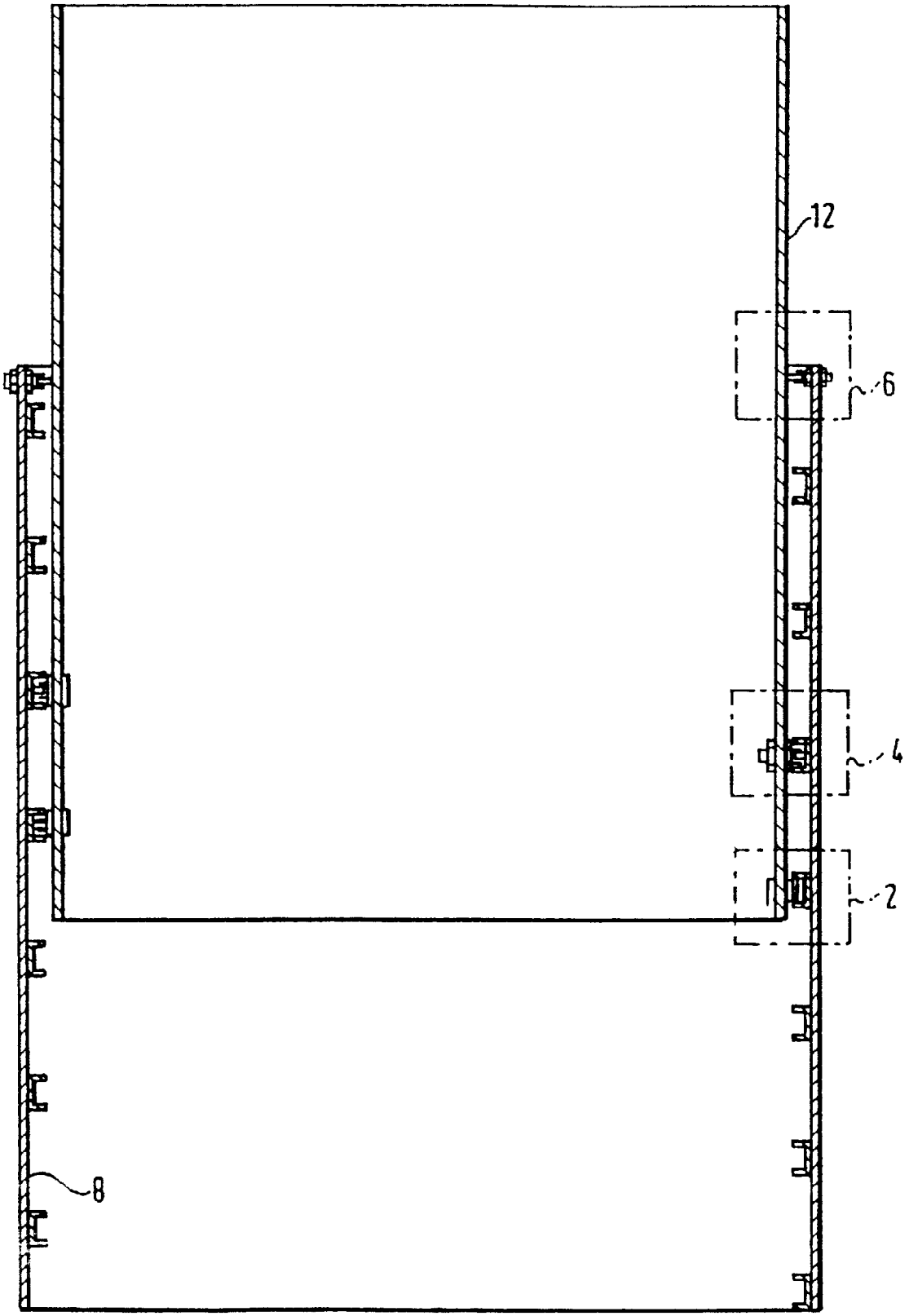
FIG. 1 shows a sectional elevation of a partially extended actuating mechanism according to the first embodiment.
Figure 2:
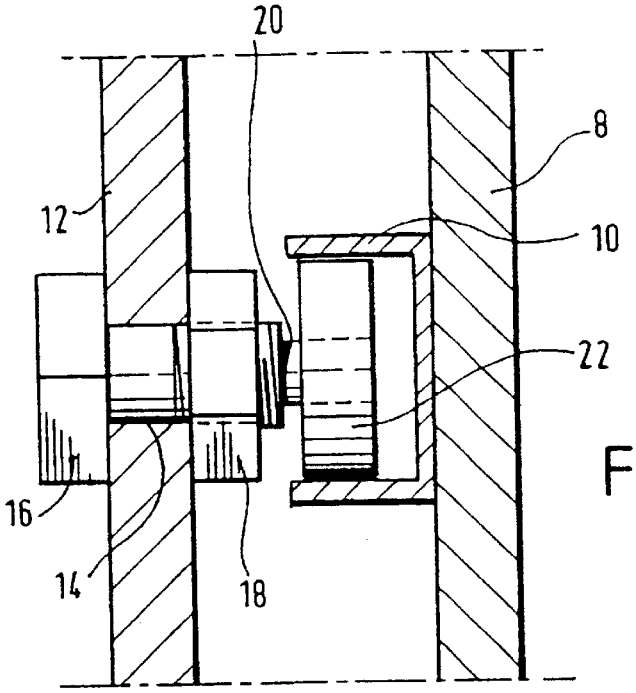
FIG. 2 shows an enlargement of a portion of the mechanism shown in FIG. 1.
Figure 3:
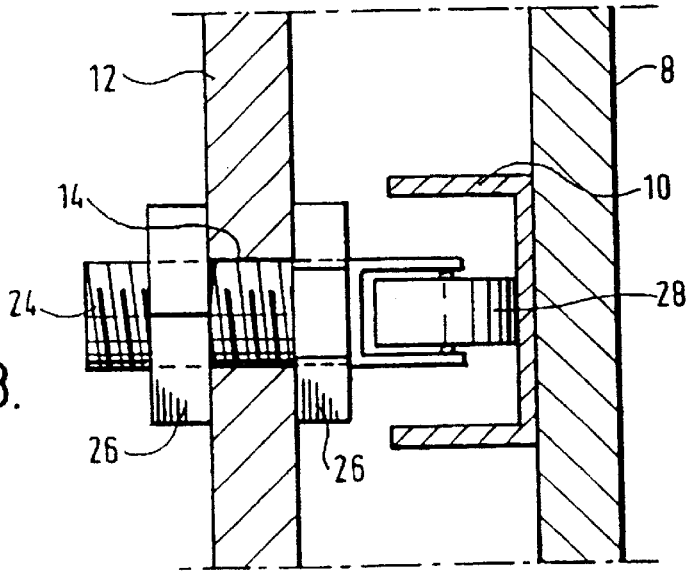
FIG. 3 shows an enlargement of another portion of the mechanism shown in FIG. 1.
Figure 4:
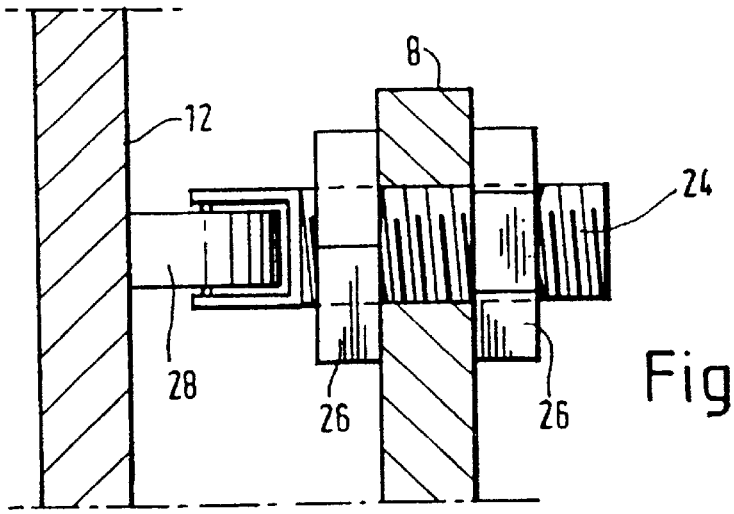
FIG. 4 shows an enlargement of another portion of the mechanism shown in FIG. 1.
Figure 5:
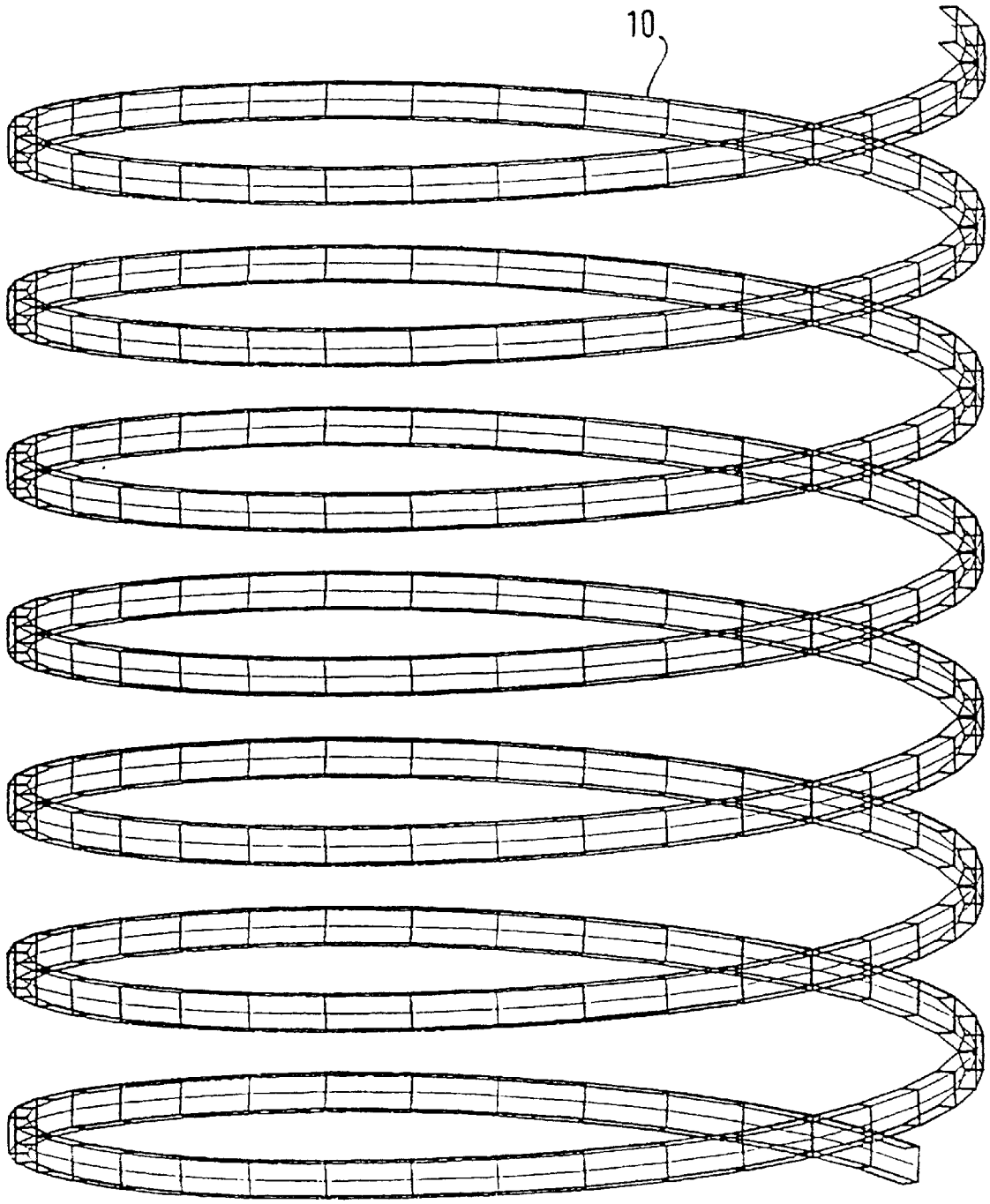
FIG. 5 shows a perspective of part of the mechanism shown in FIG. 1.

An embodiment of a dish actuating mechanism shown in FIG. 1 has enlarged cross sections of outlined areas 2, 4 and 6 shown in FIGS. 2, 3 and 4 respectively. This embodiment will now be described with reference to FIGS. 1–5. It comprises a large diameter cylinder 8, the diameter of which is approximately 1 meter with 12 mm thick walls. Fixed inside this cylinder is a length of rolled steel channel 10, bent to a helical shape shown in FIG. 5. This channel 10 is bolted or welded to the cylinder 8. The sectional dimensions of this channel are 40 mm×20 mm. The outer diameter of the helix is equal to or slightly less than the inner diameter of cylinder 8, so that it can just fit inside the cylinder and be fixed to the inner wall of the cylinder. The pitch of the helix is about 100 mm.

A further cylinder 12 has on outer diameter small enough to fit inside and clear the inner diameter of the helical channel. The cylinder 12 has a diameter of about 900 mm. On the bottom of cylinder 12 are holes 14 arranged in helical pattern of the same pitch as that of the helix of channel 10. Through some, but not all, of these holes are bolts 16 held in place with nuts 18 as shown in FIG. 2. Bolts 16 have a reduced diameter shank 20 at the end of the threaded portion. On this shank is a wheel, roller or bearing 22. This wheel or bearing is of slightly smaller diameter than the distance between the flanges of channel 10.

The remaining holes 14 in cylinder 12 each contain a threaded rod 24, shown in detail in FIG. 3. This rod is held in place with nuts 26 on either side of cylinder 12. Fixed to the outside end of rod 22 is wheel or bearing 28 which has an axis of rotation parallel to the pitch of helix of channel 10. This wheel runs on the bottom of channel 10.

A further set of holes 30 are positioned near the top of cylinder 8 in a plane parallel to the level top of the cylinder. In these holes are rods with holes on their ends identical to rods 24 and wheels 28, as shown in FIG. 4. However these wheels are on the inside of cylinder 8 and run on the outside of cylinder 12. In this case, a helical strip of steel may be provided on the outside of the cylinder along which the wheels run to prevent wear of the cylinder 12.

Rather than fixing the guide means using threaded fasteners, the guide means could be welded or otherwise secured.

To extend the actuating mechanism, cylinder 8 is rotated whilst the rotation of cylinder 12 is prevented. Wheels 22 turn inside helical channel 10 as cylinder 8 rotates, making cylinder 12 extend from the inside of cylinder 8. Wheels on rods 24 in holes 30 run on the outside of cylinder 8 and hold cylinder 12 in the centre of cylinder 8 during extension, reducing the chances of the mechanism buckling.

Threaded rods 24 are used to provide adjustment of wheels 22 in the radial direction of the cylinders. This reduces the cost of the cylinders by allowing standard sizes of cylinder to be used. Bolts 16 could also be replaced by threaded rods held in place with nuts on either side to allow for the radial adjustment of wheels 28 to match the diameter of the cylinder.

The load lifted by the mechanism is therefore transferred from cylinder 12 to cylinder 8 through channel 10 and wheels 22 to place bolts 16 in shear. The depth of the bottom portion of cylinder 12 which contains holes 14, bolts 16 and wheels 22 is determined by the number of bolts 16 required to provide sufficient strength to carry the load placed on the actuating mechanism.

In the first embodiment wheels 22 have sufficient clearance to turn between the flanges of channel 10. Thus if the load in the mechanism changes from compression to tension, then the mechanism will extend until this wheel touches the top flange of channel 10, causing excessive movement of the dish and loss of accurate tracking. This can be overcome by arranging holes 14 and wheels 22 on cylinder 12 as shown in FIG. 6.

Figure 6:
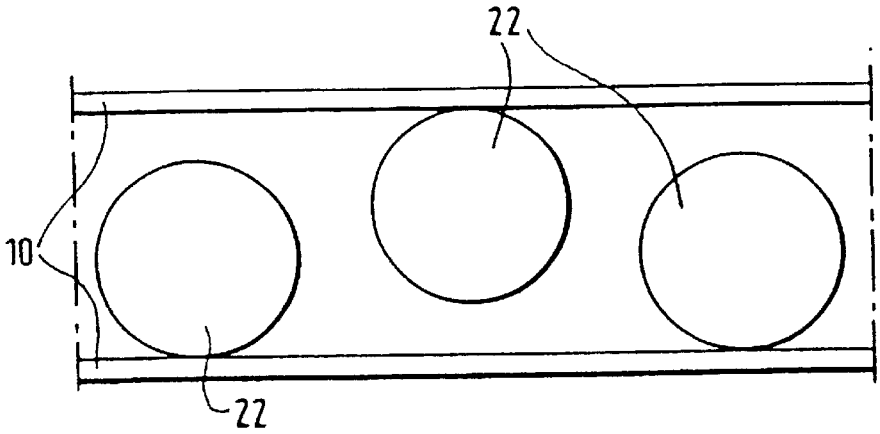
FIG. 6 shows a side elevation of an alternative arrangement of the portion of the mechanism shown in FIG. 2.

FIG. 6 shows a second embodiment with holes 14 staggered so as to place some of wheels 22 in contact with the bottom flange of the channel and others in contact with the top. Thus when the force on the mechanism moves from compression to tension, some wheels are already in contact with either flange of the channel, so the mechanism cannot extend. This could also be achieved by using much smaller wheels 22 and placing them on bolts through holes 14 with one hole positioned approximately vertically above the other to give a pair of wheels one above the other, as in FIG. 7. The wheels may or may not be in contact with each other.

Figure 8:
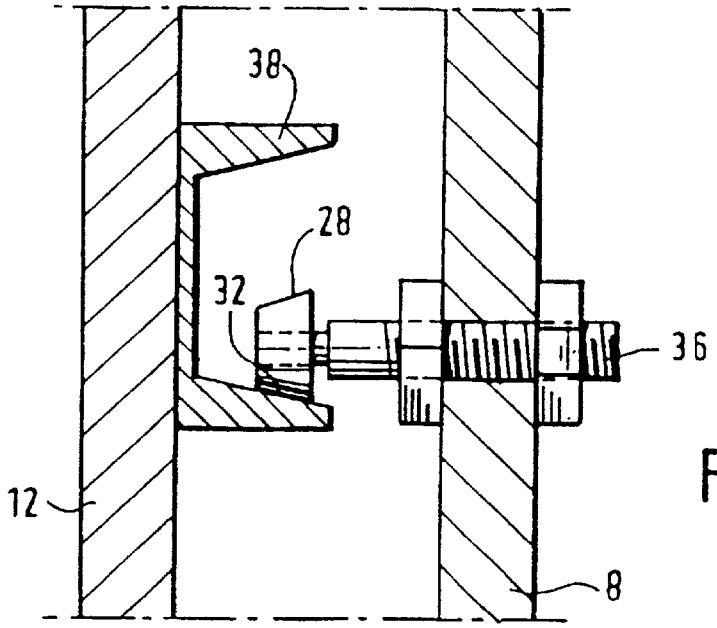
FIG. 8 shows a sectional elevation of alternative to the portion of the mechanism to that shown in FIG. 2; and, FIG. 9 shows another alternative to the portion of the mechanism shown in FIG. 8.
Figure 9:
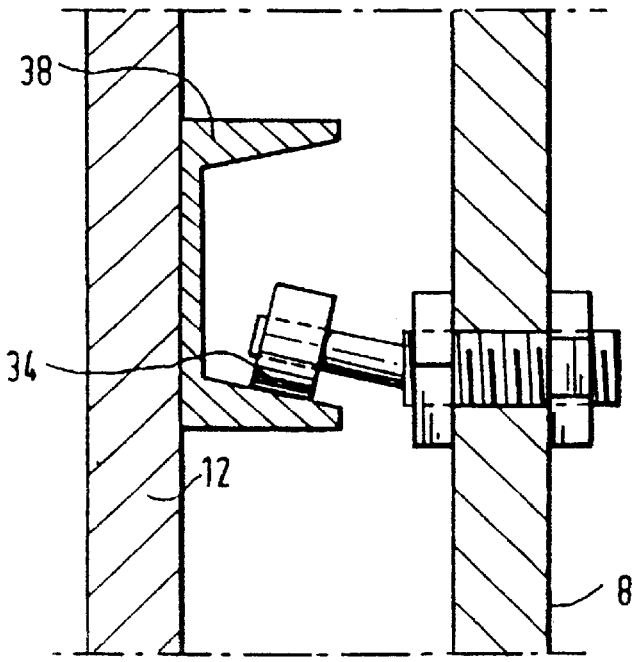

Wheels 28, which are on the end of rods 24 in some of holes 14, would not be needed if channel 38 with a tapered flange were used as in the embodiment shown in FIG. 8. In this embodiment wheels 28 are tapered themselves to match the taper 32 of channel 38. In the embodiment shown in FIG. 9 rod 36 is bent to place wheel 22 on an angle which matches the taper of channel 38.

Figure 7:
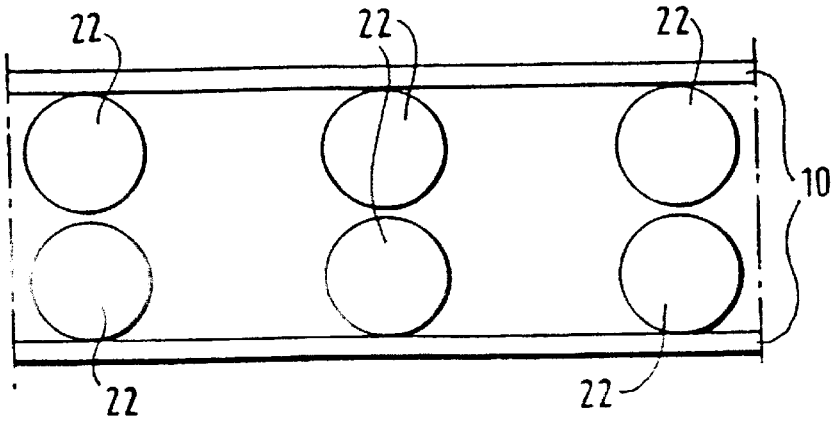
FIG. 7 shows a side elevation of another alternative arrangement of the portion of the mechanism shown in FIG. 2.

In both these embodiments bolts 16 are replaced with threaded rods 36 similar to rods 24 to allow for adjustment of the wheels to fit the cylinders and the channel. The tapered channel and wheels 32 or 34 hold cylinder 12 in the centre of cylinder 8 because movement of cylinder 12 in any lateral direction would try to push wheels 32 or 34 deeper into the channel where the space between the flanges is smaller and the wheels cannot fit. For this reason staggered wheels or two wheels as shown in FIGS. 6 and 7 must be used with this embodiment. If one wheel were used, as in the first embodiment, without wheels 28, it would have to be tapered similar to wheels 32, and sideways movement of cylinder 12 inside cylinder 8 would cause wheel 22 to jam in the taper and not turn.

It is also possible to place a helical channel similar to 10 on the outside of cylinder 12 facing outwards and place wheels 22 and 28 on the inside of cylinder 8 facing inwards. In this case, the wheels 28 will keep the cylinder 12 centred in cylinder 8.

Channels 10 can be replaced with other shapes of cross section such as angles of rolled steel bars. In these cases the helical members are in pairs with heels 22 running between each pair. The vertical distance between the members forming each pair need not be the same as the distance between the pairs themselves.

The helical guideway is preferably formed of stainless steel, as are the other components.

Instead of the U-shaped helical guideway, the guideway can include a simple projection, and in this case the wheels or other guide means run along the sides of the projection and the side of the cylinder.

The extension of the mechanism can be increased if it is made telescopic. Here a further cylinder with wheels attached to it in a similar manner to those attached to cylinder 12 would be placed inside cylinder 12. The diameter of this cylinder may be 800 mm. The wheels similar to wheels 22 and 28 attached to this smallest diameter cylinder would interact with a helical channel similar to channel 10. The outer diameter of this channel would be small enough to just fit inside and be fixed inside cylinder 12. To prevent the two cylinders overextending and leaving the top of the actuating mechanism, a form of stop would be needed at the top of cylinders 8 and 12.

What is claimed is:

1. An actuator comprising:

a first generally cylindrical member;

a second generally cylindrical member received at least partially within, and co-axial with, the first generally cylindrical member;

a generally helical guideway provided on one of the first and second generally cylindrical members; and, a plurality of guide means provided in a generally corresponding helical arrangement on the other of the first and second generally cylindrical members and being arranged to run along the helical guideway, in which relative rotation of the first and second generally cylindrical members about their common axis causes the guide means to run along the helical guideway to cause relative axial movement between the first and second generally cylindrical members.

2. An actuator according to claim 1, in which the guideway is formed as a separate member to the cylinder.

3. An actuator according to claim 1, in which the helical guideway is provided on the inner surface of the first generally cylindrical member, and the plurality of guide means are provided on the outer surface of the second generally cylindrical member.

4. An actuator according to claim 3, in which the generally helical guide way is formed as a projection from the side wall of the respective generally cylindrical member.

5. An actuator according to claim 1, in which the helical guideway is in the form of a channel.

6. An actuator according to claim 5, in which the guide means are arranged to run inside the channel.

7. An actuator according to claim 6, in which the guide means include a first set of guide means which contact the base of the channel.

8. An actuator according to claim 7, in which the guide means include a second set of guide means which engage the side walls of the channel.

9. An actuator according to claim 5, in which the guide means are rotatable guide means such as wheels or rollers.

10. An actuator according to claim 9, in which a first set of rotatable guide means are arranged with an axis of rotation generally parallel to the base of the channel, and in which the rotatable guide means have a width smaller than the width of the channel.

11. An actuator according to claim 10, in which the first set of rotatable guide members are arranged to contact and run along the base of the helical guideway channel.

12. An actuator according to claim 10, in which a second set of the rotatable guide means are arranged with an axis of rotation generally parallel to the flanges.

13. An actuator according to claim 12, in which the second set of rotatable guide means have a diameter less than the spacing between the opposed side walls of the channel.

14. An actuator according to claim 12, in which the second set of guide means are slightly offset from the helical path of the helical guideway such that some of the second set of guide means contact and run along one side wall of the channel, and the others of the second set of guide means contact and run along the opposite side wall of the channel.

15. An actuator according to claim 1, in which the helical guideway is provided on the outer surface of the second generally cylindrical member and the plurality of guide means are provided on the inner surface of the first cylindrical member.

16. An actuator according to claim 15, in which the generally helical guideway is formed as a projection from the side wall of the second generally cylindrical member.

17. An actuator according to claim 16, in which one set of guide means are rotatable about an axis generally parallel to the side wall of the first generally cylindrical member.

18. An actuator according to claim 17, which a second set of rotatable guide means may be provided which are rotatable about an axis generally parallel to the side faces of the projection, and which means are arranged to run along the side faces of the projection.

19. An actuator according to claim 18, in which some of the second set of guide means contact and run along one side face of the projection and others of the second set of guide means contact and run along the other side face of the projection.

20. An actuator according to claim 1, in which the radial position of the guide means are adjustable.

21. An actuator according to claim 20, in which the radial position of the guide means is achieved by providing the guide means on a threaded shaft, in which case the distance between the side of the generally cylindrical member on which the guide means are mounted and the guide means themselves can be adjusted by rotation.

22. An actuator according to claim 1, comprising further generally cylindrical members connected to the first or second side member by a similar arrangement of generally helical guide means and a plurality of guide members which are arranged in a generally corresponding helical fashion.

23. An actuator according to claim 1, in which the guide means are rotateable guide means such as wheels or rollers.

24. An actuator according to claim 1, in which guide means are provided on the generally cylindrical member on which the helical guideway is provided, these guide means being arranged to contact the side wall of the other generally cylindrical member.

* * * * *